US008435139B2

(12) United States Patent
Whitehouse

(10) Patent No.: US 8,435,139 B2
(45) Date of Patent: May 7, 2013

(54) GOLF TEE

(76) Inventor: Robert S. Whitehouse, Lexington, MA (US)

( * ) Notice: Subject to any disclaimer, the term of this patent is extended or adjusted under 35 U.S.C. 154(b) by 88 days.

(21) Appl. No.: 12/086,208

(22) PCT Filed: Dec. 7, 2006

(86) PCT No.: PCT/US2006/046672

§ 371 (c)(1),
(2), (4) Date: May 21, 2009

(87) PCT Pub. No.: WO2007/067687

PCT Pub. Date: Jun. 14, 2007

(65) Prior Publication Data

US 2009/0264224 A1 Oct. 22, 2009

Related U.S. Application Data

(60) Provisional application No. 60/748,498, filed on Dec. 8, 2005.

(51) Int. Cl.
*A63B 57/00* (2006.01)

(52) U.S. Cl.
USPC ..... 473/387; 473/402

(58) Field of Classification Search ..... 473/387–403; D21/717, 718
See application file for complete search history.

(56) References Cited

U.S. PATENT DOCUMENTS

D71,470 S * 11/1926 Lugar ..... D21/718
1,623,782 A * 4/1927 Dent et al. ..... 473/392
1,638,527 A * 8/1927 Clausing ..... 473/402
1,671,630 A * 5/1928 Duganne ..... 473/395
2,153,260 A * 4/1939 Mayl ..... 473/389
2,455,705 A * 12/1948 Seager ..... 473/402
4,783,077 A * 11/1988 Lemon ..... 473/402
5,040,792 A * 8/1991 Takigawa ..... 473/399
D326,129 S * 5/1992 Hirschmann ..... D21/718
D350,798 S * 9/1994 Luther ..... D21/718
D393,301 S * 4/1998 Koskela ..... D21/718
6,010,413 A * 1/2000 Pan-Chung ..... 473/402
D482,086 S * 11/2003 Metz ..... D21/718
D485,591 S 1/2004 Bonfanti
D488,525 S 4/2004 Cardarelli
D491,619 S 6/2004 Crouse
D492,743 S * 7/2004 Boyarko ..... D21/717
D501,902 S 2/2005 Bonfanti
6,849,001 B2 2/2005 Simpson
D502,972 S 3/2005 DeLisle et al.
D511,193 S * 11/2005 Trawoger ..... D21/718

(Continued)

OTHER PUBLICATIONS

Examination Report Under Section 18(3) dated Jan. 29, 2010, in connection with corresponding United Kingdom Application No. GB0809945.9.

(Continued)

*Primary Examiner* — Steven Wong
(74) *Attorney, Agent, or Firm* — Kilyk & Bowersox, P.L.L.C.

(57) ABSTRACT

According to various embodiments, the present teachings comprise a golf tee. The golf tee can comprise a point section, a shaft section, and a head section. The shaft section can comprise four opposing arms configured to allow for improved ground penetration. The head section can comprise a circular dish having a rim with a number of raised points disposed on the rim. The head section can comprise opposing arms, each having a raised point.

18 Claims, 5 Drawing Sheets

U.S. PATENT DOCUMENTS

| | | | | |
|---|---|---|---|---|
| 2004/0067802 | A1* | 4/2004 | Salsman | 473/387 |
| 2005/0148410 | A1* | 7/2005 | DeLisle et al. | 473/387 |
| 2006/0276268 | A1* | 12/2006 | Hung | 473/387 |
| 2009/0170638 | A1* | 7/2009 | Su | 473/401 |

OTHER PUBLICATIONS

Office Action dated Jan. 14, 2010, in connection with corresponding Canadian Application No. 2,640,872.

Notification of Transmittal dated Jun. 19, 2008, from PCT Application No. PCT/US2006/046672.

International Preliminary Report on Patentability dated Jun. 11, 2008, from PCT Application No. PCT/US2006/046672.

Written Opinion of International Searching Authority dated Oct. 12, 2007, from PCT Application No. PCT/US2006/046672.

International Search Report dated Oct. 12, 2007, from PCT/US2006/046672.

* cited by examiner

GOLF TEE

FIELD OF THE INVENTION

This invention relates to golf tees.

BACKGROUND TO THE INVENTION

Many designs for golf tees exist. Those that are acceptable for use in competition golf matches comprise a shaft section with a point for inserting the tee into the ground and a head or cup component for holding the golf ball. The nature of the shaft design is critical in providing a tee that is easily inserted into the ground with minimal force, but good holding power in all soil conditions. The head geometry has to provide a location point for the golf ball and allow for easy removal during the driving shot with no adverse effect on the direction and trajectory of the golf ball.

U.S. Design Pat. No. 502,972, published Mar. 15, 2005, describes a conventional tapered circular shaft design with a head having four raised portions that provide contact points for supporting the golf tee. The design shown has a very substantial shaft cross-section making it potentially difficult to drive into heavy ground. The mass of the golf tee is also likely to be substantial, potentially making the tee relatively expensive.

U.S. Design Pat. No. 501,902, published Feb. 15, 2005, describes a circular headed golf tee with a cylindrical shaft having a slight taper and then converging to a point at the very end of the shaft. The head portion of the tee is relative thick and large with an external depth approximately 15-20% the total length of the shaft. Six small shallow fluted chamfers stopped at both ends have been introduced to the underside of the head, presumably to reduce some of the mass from this heavy mass portion of the tee. The tapered cylindrical shaft also has three small shallow fluted chamfers stopped at the underside of the tee head and at the shaft pointed section of the shaft.

U.S. Pat. No. 6,849,001, published Feb. 1, 2005, describes a golf tee comprising a peg member for insertion into the ground and a flexible holding member for locating the seat portion for the golf ball to the peg. Whilst the performance of the driving action may be improved by adjusting the position of the seat portion, the design is highly complex making it uneconomic for normal golf activities.

In U.S. Design Pat. No. 491,619, published Jun. 15, 2004, a golf tee contains a golf ball supporting structure comprising 12 circular groups of fibers located around the outer circumference of a round head. A conventional cylindrical shaft is fitted to the lower portion of the tee head.

In U.S. Design Pat. No. 492,743, published Jun. 6, 2004, a tee has a conventional tapered cylindrical shaft, however the head is shaped like an inverted hollow truncated cone with the truncated point attached to the shaft. Four sections from the sides of the truncated cone shaped head have been removed presumably to reduce mass. The top of the tee head that is in contact with the golf ball has four very small protruding dimples to provide small contact points with the golf ball. The location of the four dimples is in the form of an isosceles trapezoid. The form of this golf tee would be extremely difficult to mass-produce, thus making it less commercially viable.

U.S. Design Pat. No. 488,525, published Apr. 13, 2004, describes a golf tee with three points arranged in a triangular array as the location point for the golf tee. The drawing in said application appears to indicate that the pointed head is carved from the thicker portion of the cylindrical shaft. This design would be expensive and extremely difficult to replicate for a large volume market such as commercial golf tees.

U.S. Design Pat. No. 485,591, published Jan. 20, 2004, describes a circular head with a hemispherical depression. The shaft is essentially square in cross section with a very slight taper along the main length of the shaft before tapering to a point. It is clear that the head of the tee provides continuous contact with a golf ball around the entire circumference of the tee head and in the depression of the head. The geometry of the golf tee head and shaft show no apparent benefits in improving the holding capability or driving capability of a golf ball.

None of the above patent applications describe a golf tee which meets all the current requirements of low cost production, low mass, good penetration into the ground under all conditions and the ability to balance a golf ball on the head component with minimal contact area.

SUMMARY OF THE INVENTION

The present invention relates to a novel golf tee having a shaft that is cross-shaped in cross-section and provides excellent strength and ground penetration. The golf tee comprises a head design that can minimize contact between a golf ball and the tee. The golf tee can be manufactured, for example, from non-degradable or biodegradable polymeric compositions. The golf tee can be mass produced using, for example, conventional compression molding or injection molding operations.

BRIEF DESCRIPTION OF THE DRAWINGS

The invention is described below with reference to drawings that are exemplary only, and not intended to limit the scope of the present teachings, in any way. In the drawings.

DETAILED DESCRIPTION OF THE INVENTION

The present invention relates in part to a novel golf tee having a shaft section connecting a head section and a point section. The shaft section can comprise a cross-shaped shaft construction and can provide, for example, optimum strength and ground penetration. The head section can comprise a small cross-sectional design for minimizing contact between a golf ball and the tee.

The golf tee can be manufactured from any suitable material. Exemplary materials include wood, plastic, metal, and composite materials. For example, the golf tee can comprise a non-degradable or a degradable polymeric composition. The golf tee can be made in mass production using conventional compression molding or injection molding operations.

According to various embodiments, the golf tee can comprise a cross-shaped shaft section connecting a head section to a point section of the tee. The point section can be used to assist initial penetration of the tee into the ground. The head section can comprise a hole, depression, or other recess in the axial center thereof. The head section can comprise one or more bumps, protrusions, or protuberances, herein referred to as projections or points, along a periphery thereof. The projections can form points of contact with a golf ball. Any number of projections can be provided on the head section, for example, two, three, or four projections. The diameter of the head section can be expanded outwardly relative to the diameter of the shaft section to thereby increase the area between contact points on the golf ball. The head section can taper outwardly from its intersection with the shaft section to a rim that can be the most distant feature from the point section.

In some embodiments, the golf tee comprises a cross-shaped shaft section comprising four arms wherein the shaft section is disposed between the head section and the point section. The golf tee has a total length, the point section has a length, and the shaft section has a length. Each arm extends outwardly at a first angle in a direction from the point section to the head section and each arm terminates in an outermost distal edge. The head section tapers outwardly at a second angle in the direction, and the second angle is greater than the first angle. The head section tapers continuously from the outermost distal edges inwardly to an intersection with the cross-shaped shaft section. The outermost distal edges are more distant from the point section than any other feature of the golf tee, and the outermost distal edges are configured to provide contact points with a golf ball when in use.

Figure 1:
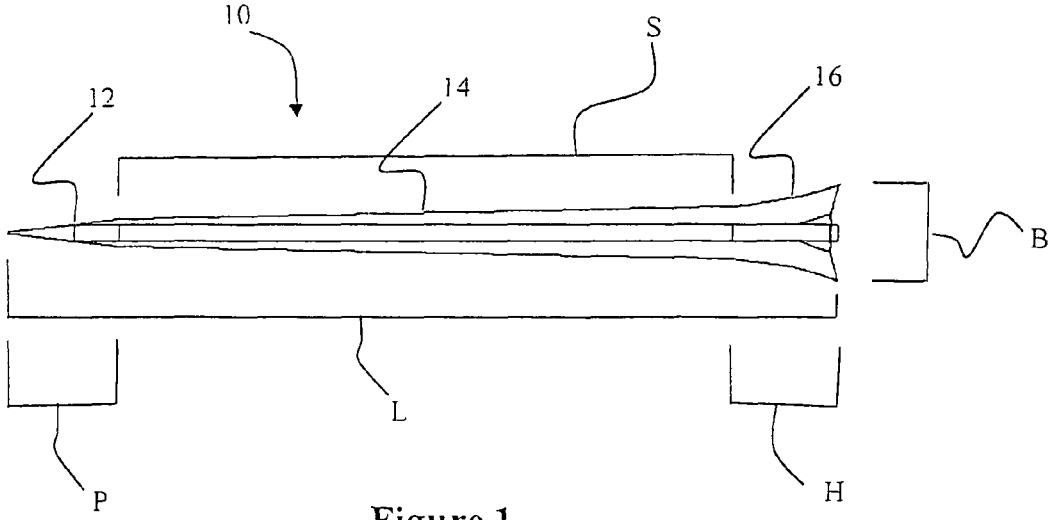
FIG. 1 is a top plan view of a golf tee according to various embodiments.
Figure 2:
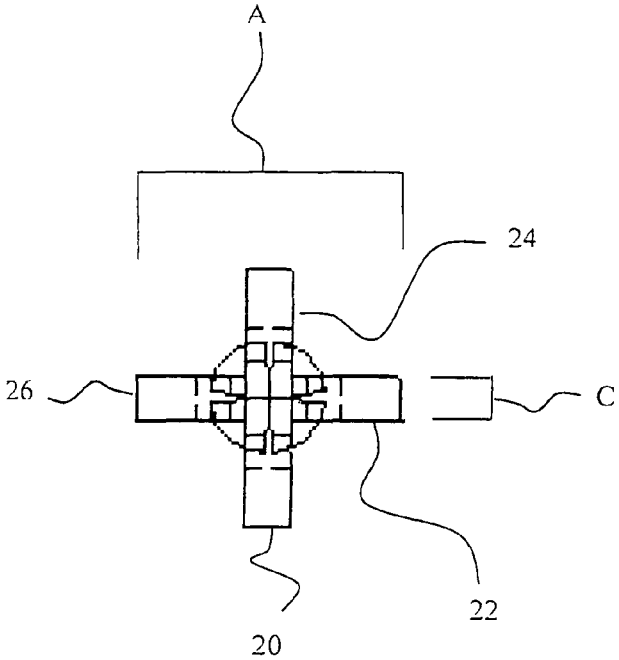
FIG. 2 is an axial view of a golf tee according to various embodiments.
Figure 3:
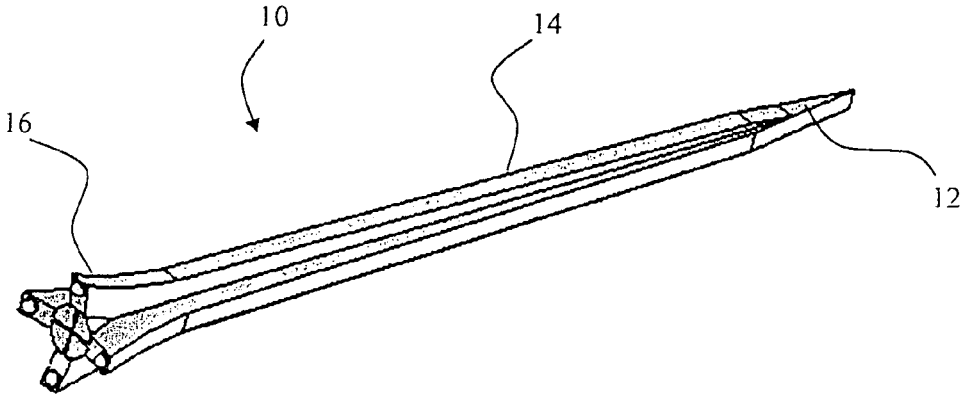
FIG. 3 is a perspective view of a golf tee according to various embodiments.

Exemplary golf tees according to various embodiments are shown in the Figures. FIG. 1 is a side view of a golf tee according to various embodiments. FIG. 2 is an end view of the golf tee shown in FIG. 1, taken from the head section end of the golf tee. FIG. 3 illustrates a perspective view of a golf tee similar to that shown in FIGS. 1 and 2, with the exception that the golf tee shown in FIG. 3 comprises four projections at the head section thereof. In FIGS. 1, 2, and 3, golf tee 10 can comprise a point section 12, shaft section 14, and a head section 16.

According to various embodiments, the total length L of the golf tee 10 can be from about 15 mm to about 100 mm. More preferably, the total length L can be from about 20 mm to about 85 mm. In certain embodiments, the total length L can be from about 25 mm to about 75 mm, for example, about 50 or about 60 mm.

According to various embodiments, the length H of head section 16 can be from about 5% to about 80% of the total length L. In some embodiments, length H can be from about 7% to about out 70% of the total length L. More preferably length H can comprise about 9% to about 50% total length L, or from about 12% to about 25% of total length L.

According to various embodiments, the length P of point section 12 can be from about 5% to about 80% of the total length L. Preferably length P can be from about 7% to about 70% of total length L. For example, length P can be from about 9% to about 50% of total length L. In some embodiments, length P can be from about 12% to about 25% of total length L.

According to various embodiments, the length S of shaft section 14 can be from about 2% to about 90% of the total length L. Preferably length S can comprise from about 10% to about 85% or total length L. More preferably length S can comprise about 15% to about 80% of total length L. Most preferably length S can comprise from about 20% to about 75% of total length L.

According to various embodiments, the shaft section 14 can comprise any of a variety of cross-sectional shapes. For example, the shaft section can be cross-shaped in cross-section. In some embodiments, shaft section 14 can comprise a plurality of arms, for example, two opposing pairs of arms. In an exemplary embodiment, the shaft section 14 can comprise a first pair of arms 20 and 24, and a second pair of arms 22 and 26.

The arms can be of any suitable thickness. For example, thickness C of arms 20, 22, 24, and/or 26, can be from about 0.7 mm to about 4 mm, from about 0.8 mm to about 3 mm, or from about 0.9 mm to about 2.5 mm. The thickness of each arm can be the same or different than the thickness of one or more of the other arms.

Each arm, for example, each of arms 20, 22, 24, and 26, can have the same or a different cross-section as one or more of the other arms. In some embodiments, each arm can be rectangular in cross-section, triangular in cross-section, or trapezoidal in cross-section. The length between the tips of opposing set of arms, for example, the dimensions A and B shown in FIGS. 1 and 2, can be from about 3 mm to about 25 mm, more preferably from about 4 mm to about 15 mm, or from about 5 mm to about 10 mm. Lengths A and B can be the same as each other or different. Preferably dimension A can be from about 85% to about 115% the value of dimension B. In some embodiments, dimension A can be from about 95% to about 105% of dimension B or dimension A can be about the same as dimension B.

According to various embodiments, head section 16 can be tapered such that its outer periphery or outer diameter gets smaller at it approaches an intersection with shaft section 14. For example, the outer periphery of head section 16 can be reduced to from about 50% to about 80% the dimension of distance B (see FIG. 1) along length H of head section 16.

According to various embodiments, the arms can be tapered such that depth of each arm can be reduced at the area where the arm approaches the point section of the tee, relative to the depth of the same arm at the head section of the tee. Herein, the depth refers to the thickness dimension of the arm in a direction radially outwardly from the central axis of the golf tee.

In some embodiments, the unattached extremity of each arm at the head section can be reduced in thickness C (FIG. 2) to be from about 50% to about 20% of the thickness C of the arm at the opposite attached end of the arm at the intersection with the point section.

Figure 4:
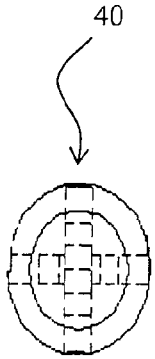
FIG. 4 is an axial view of a golf tee according to various embodiments.
Figure 5:
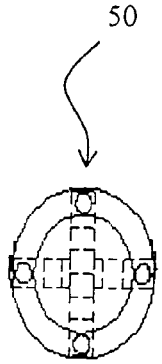
FIG. 5 is an axial view of a golf tee according to various embodiments.
Figure 6:
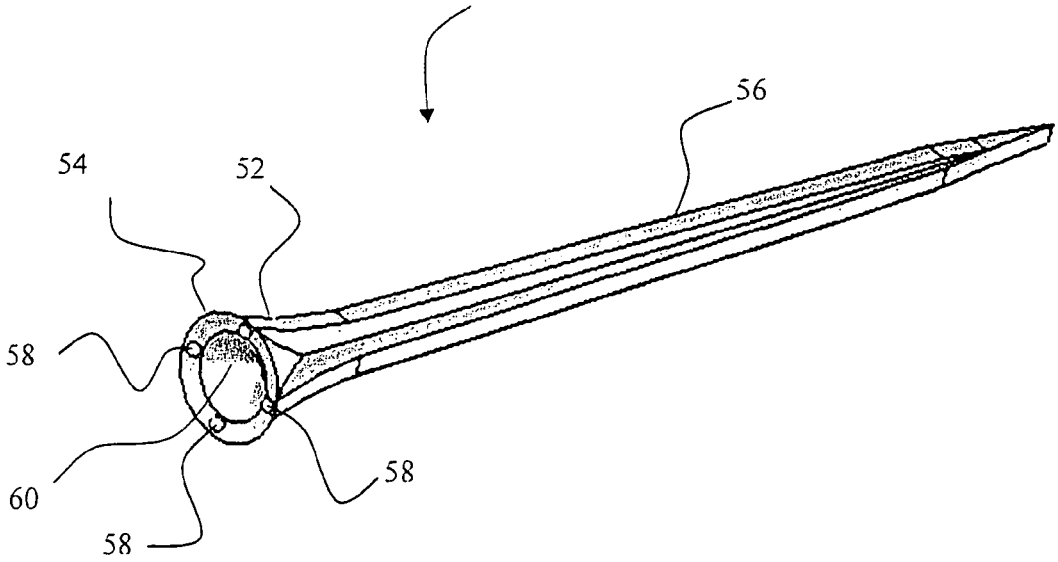
FIG. 6 is a perspective view of a golf tee according to various embodiments.

FIGS. 4, 5, and 6 illustrate a golf tee 50 having a head section 52 that comprises a circular dish 54. The head section can be fitted to, or formed concurrently with, a shaft section 56. Dish 54 can have any suitable diameter, for example, a diameter of from about 4 mm to about 40 mm, from about 5 mm to about 20 mm, or from about 7 mm to about 12.5 mm. Dish 54 can have a gradual reduction in wall thickness from an area of greatest diameter to an area of smaller diameter at the center of the head section 52. Head section 32 can comprise a depression or recess 60. The depth of recess 60 can be from about 0.02 mm to about 3 mm. More preferably, the depth can be from about 0.05 mm to about 2 mm or from about 0.1 mm to about 1 mm.

According to various embodiments, and as shown in FIGS. 5 and 6, the head section can comprise a number of raised points 58. For example, the head section can comprise at least three raised points raised around the circumference of the distal end of head section 52. In some embodiments, head section 52 can comprise 4 or 6 raised points, for example, 4 raised points. Raised points 58 can extend to a height above the dish of, for example, from about 0.1 mm to about 2 mm.

Figure 7:
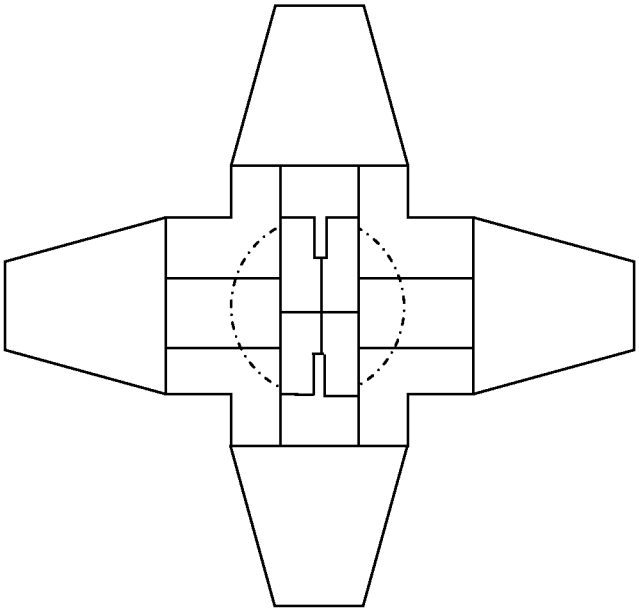
FIG. 7 is an axial view of a golf tee according to various embodiments.
Figure 8:
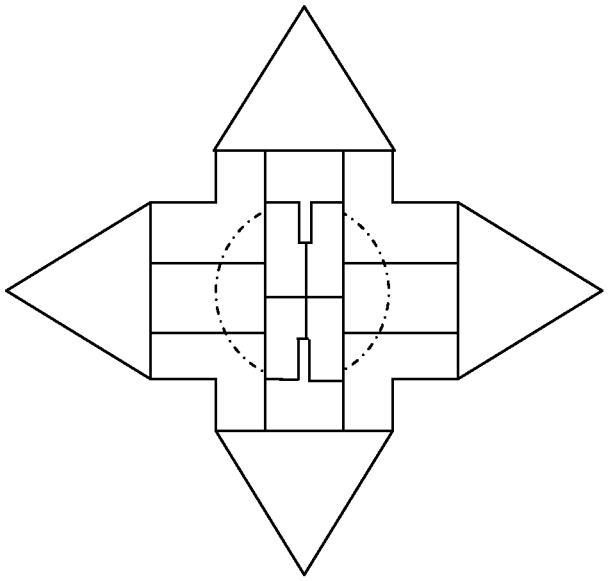
FIG. 8 is an axial view of a golf tee according to various embodiments.

According to various embodiments not shown, the golf tee can comprise shaft arms having a trapezoidal cross-sectional shape, for example, wherein a larger side of the trapezoid faces the center of the tee and a shorter side of the trapezoid faces away from the center, as shown in FIG. 7. In this embodiment, the thickness of each shaft arm at the center of the golf tee is larger that the width of each arm at the extremities of the golf tee. Preferably, the width of each arm at the corresponding extremity of the golf tee is from about 1% to about 99% the width of the arm at the center. More preferably, the width of the arm is from about 2% to about 50% the width at the center. In some embodiments, each shaft arm can comprise a cross-section in the shape of an isosceles triangle, as shown in FIG. 8.

According to various embodiments, the golf tee can be produced from a polymeric resin system, for example, by either compression molding or injection molding. The polymeric resin system can be biodegradable or non-biodegradable. A non-biodegradable polymeric resin system can be a thermoplastic polymeric composition selected from at least one of the following: ethylene homopolymers or copolymers: propylene homo-polymers or copolymers; polystyrene; high impact polystyrene; ABS; SAN; PET; polyurethane; or polyamides. Polyamides can comprise, for example, nylon 6, nylon 6,6, nylon 11, or nylon 12.

According to some embodiments, the golf tee can comprise a biodegradable polymeric resin material comprising one or more of the following: polylactic acid; polyglycolic acid; polycaprolactone; polyalkylene carbonates; polyhydroxyalkanoates; polyvinyl alcohol; natural or chemically modified starches; soy proteins; tall oil and/or wood rosins; tall oil and/or wood esters; tall oil and/or wood rosin derivatives; urea formaldehyde resins; melamine formaldehyde resins; alkyd resins; polymerized vegetable oils; polyurethanes derived from soy and other vegetable based polyols; polyurethanes derived from castor oil based derivatives; synthetic aliphatic copolyesters; and synthetic aliphatic aromatic copolyesters. Exemplary synthetic aliphatic copolyesters and synthetic aliphatic aromatic copolyesters can comprise monomers selected from: 1,4 butane diol; 1,3 propane diol; ethylene glycol; adipic acid; succinic acid; succinic anhydride; terephthalic acid; lactic acid; and combinations thereof. In some embodiments, the golf tee can comprise colophony; natural rubber; gum Arabic; cellulose acetate; cellulose butyrate; cellulose proprionate; or blends thereof.

Further embodiments of the present invention comprise a golf tee composition that easily breaks down in the soil environment present on a golf course. The tee can be easily cut during the mowing and can provide no damage to the blades of a mower.

EXAMPLES

Example 1

A golf tee of geometry shown in FIG. 1, having a total length of 75 millimeters (mm) and a head of maximum dimensions 8.9 mm, was injection molded from the biodegradable polymeric system Starpol 2189, manufactured by Stanelco Co. The composition is claimed to be a blend of thermoplastic starch, polylactic acid, and mineral filler. The mass of the molded tee was approximately 0.88 gram.

Example 2

A golf tee of geometry shown in FIG. 1, having a total length of 50 mm and a head of maximum dimensions 8.9 mm, was injection molded in the biodegradable polymeric system Starpol 2189, manufactured by Stanelco Co. The mass of the molded tee was approximately 0.72 gram.

Example 3

A golf tee of geometry shown in FIG. 1, having a total length of 75 mm and a head of maximum dimensions 8.9 mm, was produced using a photolithographic technique with an epoxide acrylate resin. The mass of the molded tee was approximately 0.83 gram.

Example 4

A golf tee of geometry shown in FIG. 1, having a total length of 75 mm, and a head of maximum dimensions 9.2 mm, and a shaft arm width of 2.1 mm, was injection molded in a biodegradable polymeric system Starpol 2189, manufactured by Stanelco Co. The composition is claimed to be a blend of thermoplastic starch, polyvinyl alcohol and mineral filler; the mass of the molded tee was approximately 1.1 grams.

Assessment of Ground Penetration

The golf tee was manually pushed into light loam and heavy dry clay soil compositions found on a typical golf course. The ease of penetration of the tee into the ground was assessed together with the shape of the hole made by the golf tee. A standard wood golf tee and a new Evolve Golfs EPOCH™ golf tee marketed by Evolve Golf, Inc., were used for comparison.

| Golf tee | Light loam | Heavy dry clay |
|---|---|---|
| Wood | Easy to push in, some distortion of the hole, slight instability in holding golf ball | Easy to push in, distortion of the hole, slight instability in holding golf ball |
| EPOCH ™ 3" tee | More difficult to push in, distortion of the hole, good holding golf ball | More difficult to push in, distortion of the hole, good holding golf ball |
| Example 1 | Very easy to push in with no hole distortion, good ball holding | Very easy to push in with no hole distortion, good ball holding |
| Example 2 | Very easy to push in with no hole distortion, good ball holding | Very easy to push in with no hole distortion, good ball holding |
| Example 3 | Very easy to push in with no hole distortion, good ball holding | Very easy to push in with no hole distortion, good ball holding |
| Example 4 | Very easy to push in with no hole distortion, excellent ball holding | Very easy to push in with no hole distortion, excellent ball holding |

These tests demonstrate the superior penetration properties of the new tee design and excellent ball holding capability. The mass of the new tee was between 50% and 70% lighter than the competitive products.

Golf Tee Driving Performance

A selection of golf tees were submitted to Golf Laboratories Inc., for performance testing under using a robotic driving club, 10 new tees were used for each test. The conditions used for the comparative testing were:

Equipment
Club: TAYLOR MADE™
Head 10.5° r7 425
Shaft REAX™ 65 "R" flex
Lie angle 54°
Robot Parameters
Amps 49

Initial percent 60
Ramp distance 31.5 in
Release point 160
Weather Conditions
Temperature 64 F
Wind 0-10 mph
Direction L-R tail
Humidity 79%
Atmospheric pressure 29.89 bar
Ground conditions soft and damp
Weather conditions cloudy and cool

| Control - 3 inch wood tee | | | | | |
|---|---|---|---|---|---|
| | Average | Standard Deviation | Max | Min | Range |
| Initial head speed mph | 102.38 | 0.22 | 102.71 | 1102.03 | 0.68 |
| Initial ball speed mph | 153.18 | 0.31 | 153.63 | 152.70 | 0.93 |
| Launch angle deg | 12.80 | 0.22 | 13.14 | 12.55 | 0.59 |
| Back spin rpm | 3438.43 | 101.85 | 3595.85 | 3258.88 | 336.97 |
| Max height of shot ft | 109.60 | 5.74 | 117.48 | 99.51 | 17.96 |
| Down range distance ball reaches peak height yds | 166.05 | 2.29 | 170.00 | 161.46 | 8.54 |
| Landing velocity mph | 44.73 | 2.67 | 48.20 | 40.81 | 7.39 |
| Carry distance ball landing yd | 247.30 | 5.17 | 254.00 | 238.00 | 16.00 |
| Carry ball dispersion ft | 11.50 | 17.45 | 33.00 | −19.00 | 52.00 |
| Total distance ball stops yd | 265.60 | 7.38 | 277.00 | 249.00 | 28.00 |
| Total dispersion ball ft | 19.30 | 25.21 | 48.00 | −20.00 | 68.00 |
| Wind velocity L-R tail mph | 4.80 | 2.10 | 8.00 | 2.00 | 6.00 |

| EPOCH ™ Tee 3.125 in | | | | | |
|---|---|---|---|---|---|
| | Average | Standard Deviation | Max | Min | Range |
| Initial head speed mph | 102.90 | 0.43 | 103.89 | 102.48 | 1.41 |
| Initial ball speed mph | 153.87 | 0.35 | 154.33 | 153.20 | 1.13 |
| Launch angle deg | 13.38 | 0.39 | 14.20 | 12.81 | 1.39 |
| Back spin rpm | 3292.32 | 105.02 | 3505.01 | 3126.58 | 378.43 |
| Max height of shot ft | 109.20 | 2.11 | 113.00 | 105.03 | 7.98 |
| Down range distance ball reaches peak height yds | 170.12 | 2.52 | 176.30 | 167.44 | 8.86 |
| Landing velocity mph | 48.48 | 1.34 | 51.37 | 46.83 | 4.53 |
| Carry distance ball landing yd | 250.30 | 4.24 | 257.00 | 244.00 | 13.00 |
| Carry ball dispersion ft | 25.50 | 15.92 | 46.00 | 4.00 | 42.00 |
| Total distance ball stops yd | 266.10 | 4.33 | 273.00 | 259.00 | 14.00 |
| Total dispersion ball ft | 34.10 | 16.83 | 66.00 | 9.00 | 57.00 |
| Wind velocity L-R tail mph | 4.00 | 2.11 | 8.00 | 2.00 | 6.00 |

-continued

Example 3

Tee

| | Average | Standard Deviation | Max | Min | Range |
|---|---|---|---|---|---|
| Initial head speed mph | 102.8 | 0.52 | 104.2 | 102.46 | 1.74 |
| Initial ball speed mph | 153.45 | 0.40 | 153.97 | 152.77 | 1.21 |
| Launch angle deg | 13.16 | 0.21 | 13.50 | 12.86 | 0.64 |
| Back spin rpm | 3154.67 | 98.39 | 3281.28 | 3007.86 | 273.42 |
| Max height of shot ft | 108.50 | 2.90 | 113.26 | 104.59 | 8.67 |
| Down range distance ball reaches peak height yds | 166.65 | 1.75 | 169.53 | 164.44 | 5.09 |
| Landing velocity mph | 47.70 | 0.64 | 49.15 | 47.04 | 2.11 |
| Carry distance ball landing yd | 252.50 | 3.44 | 258.00 | 247.00 | 11.00 |
| Carry ball dispersion ft | 5.00 | 18.64 | 32.00 | −30.00 | 62.00 |
| Total distance ball stops yd | 269.80 | 3.55 | 276.00 | 262.00 | 14.00 |
| Total dispersion ball ft | 6.00 | 21.68 | 39.00 | −39.00 | 78.00 |
| Wind velocity L-R tail mph | 1.2 | 1.32 | 3.00 | 0 | 3.00 |

Golf Tee Driving Performance Test 2
Equipment
Club: Taylor Made
Head 10.5° r7 425
Shaft REAX 65 "R" flex
Lie angle 54°
Robot Parameters
Amps 49
Initial percent 60
Ramp distance 31.5 in
Release point 160
Weather Conditions
Temperature 88 F
Wind 7-12 mph
Direction L-R cross
Humidity 31%

Atmospheric pressure 29.92 bar
Ground conditions soft and damp
Weather conditions clear and warm

| | Wood tee average | Tee example 3 average | Tee example 4 average |
|---|---|---|---|
| Initial head speed mph | 102.3 | 103.2 | 103.2 |
| Initial ball speed mph | 153.2 | 154.8 | 155.6 |
| Launch angle deg | 12.8 | 12.7 | 12.7 |
| Back spin rpm | 3438.4 | 3033.2 | 3036.1 |
| Max height of shot ft | 109.6 | 100.7 | 101.4 |
| Down range distance ball reaches peak height yds | 166.05 | 169.4 | 170.2 |
| Landing velocity mph | 44.73 | 49.7 | 50.1 |
| Carry distance ball landing yd | 247.30 | 256.9 | 258.3 |
| Carry ball dispersion ft | 6.8 | 5.4 | 3.3 |
| Total distance ball stops yd | 265.6 | 275.6 | 277.0 |
| Total dispersion ball ft | 8.1 | 0.1 | 1.6 |
| Wind velocity L-R tail mph | 12.0 | 11.8 | 11.9 |

The test data showed that, compared with a standard wood tee and the EPOCH™ tee, tee example 3 had improved driving distance, reduced back spin, and reduced dispersion spread. This demonstrates that the design provides more accuracy for the golfer.

What is claimed is:

1. A golf tee, comprising:

a head section;

a point section; and a shaft section having a cross-shaped cross-section and consisting of four arms arranged in two opposing pairs of arms;

wherein the shaft section is disposed between the head section and the point section, the golf tee has a total length, the point section has a length, and the shaft section has a length, each arm extends outwardly at a first angle in a direction from the point section to the head section, each arm terminates in an outermost distal edge, the head section tapers outwardly at a second angle in the direction, the second angle is greater than the first angle, the head section tapers continuously from the outermost distal edges inwardly to an intersection with the cross-shaped shaft section, the outermost distal edges are more distant from the point section than any other feature of the golf tee, the golf tee has a central axis, the outermost distal edges are disposed more radially outward from the central axis than is any other feature of the golf tee, and the outermost distal edges are configured to provide contact points with a golf ball when in use.

2. The golf tee of claim 1, wherein the point section length is from about 5% to about 80% of the total length.

3. The golf tee of claim 1, wherein the shaft section length is from about 2% to about 90% of the total length.

4. The golf tee of claim 1, wherein the head section length is from about 5% to about 90% of the total length.

5. The golf tee of claim 1, wherein the total length is from about 15 mm to about 100 mm.

6. The golf tee of claim 1, wherein the arms are triangular in cross-section.

7. The golf tee of claim 1, wherein the arms each have a thickness of from about 0.8 mm to about 3 mm.

8. The golf tee of claim 1, wherein the arms are rectangular in cross-section.

9. The golf tee of claim 1, wherein the arms are trapezoidal in cross-section.

10. The golf tee of claim 1, wherein the arms are triangular in cross-section, and wherein the base of each triangular cross-section is disposed adjacent to the shaft section.

11. A golf tee, comprising:

a head section;

a point section; and a shaft section having a cross-shaped cross-section and consisting of four arms arranged in two opposing pairs of arms;

wherein the shaft section is disposed between the head section and the point section, the golf tee has a total length, the point section has a length, and the shaft section has a length, each arm extends outwardly at a first angle in a direction from the point section to the head section, each arm terminates in an outermost distal edge, the head section tapers outwardly at a second angle in the direction, the second angle is greater than the first angle, the head section tapers continuously from the outermost distal edges inwardly to an intersection with the cross-shaped shaft section, the outermost distal edges are more distant from the point section than any other feature of the golf tee, the golf tee has a central axis, the outermost distal edges are disposed more radially outward from the central axis than is any other feature of the golf tee, and each arm of the two pairs of opposing arms comprises a raised point configured to completely support a golf ball.

12. The golf tee of claim 11, further comprising at least four raised points disposed upon the head section, each disposed at a distance of from about 3 mm to about 25 mm from the raised points adjacent thereto, and the raised points are configured to completely support a golf ball.

13. The golf tee of claim 11, further comprising at least four raised points disposed upon the head section at a distance of from 7 mm to 15 mm from adjacent raised points, wherein the golf tee has a total length of from 25 mm to 85 mm, the point section length is from 10% to 25% of the total length, the shaft section length is from about 15% to about 80% of the total length, the head section length is from about 10% to about 60% of the total length, and the arms have a width of from about 1.3 mm to about 3 mm.

14. The golf tee of claim 11, wherein the head section comprises a circular dish having a rim, a rim diameter, and a depth, the rim diameter is from about 4 mm to about 40 mm, and the depth is from about 0.05 mm to about 2 mm.

15. A golf tee of claim 14, wherein the dish comprises from three to eight raised points disposed upon the rim and configured to contact and completely support a golf ball.

16. The golf tee of claim 14, wherein the dish comprises four raised points disposed upon the rim, and the raised points are configured to contact completely support a golf ball.

17. The golf tee of claim 1, wherein the golf tee comprises a polymeric composition comprising one or more of a polylactic acid, a polyhydroxyalkanoate, a natural or chemically modified starch, a polyvinyl alcohol, an aliphatic copolyester, and an aromatic copolyester.

18. The golf tee of claim 17, wherein the aliphatic copolyester and the aromatic copolyester comprise two or more monomers consisting of: 1, 4 butane diol; 1, 3 propane diol; ethylene glycol; adipic acid; succinic acid; succinic anhydride; terephthalic acid; or blends thereof.

* * * * *